US008459461B2

(12) United States Patent
Borowski et al.

(10) Patent No.: US 8,459,461 B2
(45) Date of Patent: Jun. 11, 2013

(54) WASTE RECYCLING METHOD

(76) Inventors: David Borowski, Green Bay, WI (US); William Huddleston, San Diego, CA (US); Ben Thorp, Richmond, VA (US)

( * ) Notice: Subject to any disclaimer, the term of this patent is extended or adjusted under 35 U.S.C. 154(b) by 114 days.

(21) Appl. No.: 12/585,249

(22) Filed: Sep. 9, 2009

(65) Prior Publication Data

US 2011/0060451 A1 Mar. 10, 2011

(51) Int. Cl.
*B07C 5/02* (2006.01)

(52) U.S. Cl.
USPC ..... 209/3

(58) Field of Classification Search
USPC ..... 209/3, 3.3, 583, 930; 241/DIG. 38
See application file for complete search history.

(56) References Cited

U.S. PATENT DOCUMENTS 5,155,975 A * 10/1992 Knowler ..... 53/513
5,365,075 A 11/1994 Peterson
5,447,017 A * 9/1995 Becher et al. ..... 53/527
5,628,412 A * 5/1997 Hulls ..... 209/702
5,641,072 A 6/1997 Otake
5,947,256 A 9/1999 Patterson
5,960,402 A * 9/1999 Embutsu et al. ..... 705/308
6,305,548 B1 * 10/2001 Sato et al. ..... 209/3.3
6,570,653 B2 5/2003 Bruner et al.
6,766,751 B2 * 7/2004 Liu ..... 110/341
6,778,276 B2 8/2004 Bruner et al.
6,811,030 B1 * 11/2004 Compton et al. ..... 209/2
7,032,820 B2 4/2006 Kreiner et al.
7,264,124 B2 * 9/2007 Bohlig et al. ..... 209/30
7,299,982 B2 11/2007 Kreiner et al.
7,341,156 B2 * 3/2008 Bohlig et al. ..... 209/592
7,383,195 B2 6/2008 Mallett et al.
7,411,500 B2 * 8/2008 Hamerly et al. ..... 340/572.1
7,454,358 B2 11/2008 Mallett et al.
7,561,107 B2 * 7/2009 Al-Mahdawi ..... 343/700 MS
7,565,299 B2 * 7/2009 Mallett et al. ..... 705/317
7,784,399 B2 * 8/2010 Sasine et al. ..... 100/3
7,949,557 B2 * 5/2011 Fitzgerald et al. ..... 705/14.11
2006/0187058 A1 * 8/2006 Regard ..... 340/572.8
2007/0057789 A1 * 3/2007 Hamerly et al. ..... 340/572.1
2007/0267163 A1 * 11/2007 Tamai et al. ..... 162/261
2010/0071572 A1 * 3/2010 Carroll et al. ..... 100/229 A
2010/0217715 A1 * 8/2010 Lipcon ..... 705/308

* cited by examiner

*Primary Examiner* — Joseph C Rodriguez
(74) *Attorney, Agent, or Firm* — William L. Klima; Klima Law Offices, PLL

(57) ABSTRACT

A waste recycling method for tracking targeted waste from collection to recycling. The method utilizes wireless electronically tagged plastic bags containing the targeted waste or material to be recycled.

14 Claims, 2 Drawing Sheets

WASTE RECYCLING METHOD

FIELD OF THE INVENTION

A waste recycling system using tagged, bar coded or other distinctively marked plastic bags or other containers, preferably electronically tagged plastic bags or other containers for maintaining separation and custody tracking of targeted waste from collection to recycling; a method of recycling; and a plastic bag or other container device. The plastic bag or other container device according to the present invention is preferably electronically tagged and includes least one RFID or UHFID or similar wireless electronic tags for tagging the plastic bags or other container containing the targeted waste.

BACKGROUND OF THE INVENTION

Today, most waste from stores such as fast food chains, restaurants, retail and office locations is discarded by individuals (e.g. customers or employees) into waste cans or receptacles provide onsite. These waste receptacles typically are fitted with removable plastic bags, which can be closed when filled and removed from the receptacles and then disposed of in dumpsters usually located outside the buildings and adjacent to the parking lot of theses locations to facilitate removal by a waste disposal service.

Typically, the waste is not sorted and all thrown into the same waste receptacles resulting in a mix of a variety of items, including trash, garbage, paper products and other waste items. The plastic bags filled with waste are thrown into a dumpster and mixed with other plastic bags containing waste. This waste is transported in the dumpsters or garbage trucks to land fills and typically not sorted before being buried.

Currently, there exists a need to sort waste into targeted waste to allow this particular waste to be effectively recycled. Once certain types of waste are mixed together, even subsequent sorting may not allow the waste to be recycled due to the contamination from the other waste. In particular, food and beverage containers (e.g paper cups, paper containers, plastic bottles, plastic containers) should not be mixed with other waste, if the waste beverage and food containers are going to be recycled into new products suitable for contact and use with food and beverage that meet the standards and guidelines of the Food and Drug Administration (FDA). Further, to ensure proper handling of the waste food and beverage containers, the custody of this waste from the point of disposal (e.g. store waste receptacle) through recycling of this waste must be established, tracked, and maintained to assure no contamination thereof. Thus, it is preferred that this type of wasted be immediately sorted and maintained separate from the general mixed waste stream throughout collection, transport, storage, and recycling thereof.

Due to the large amount of labor involved with sorting, it is desirable that the user or consumer of the food or beverage container begin the process of sorting by placing these items in marked collection bins or receptacles. For example, placing used paper cups into a marked waste receptacle for used paper cups only begins the process of effectively sorting this waste. The marked containers would contain a bag type removable liner, which when filled could be removed and disposed of.

In the case of paper cups, the paper substrate is of a high quality paperboard stock, which has been treated with a plastic, wax, or resin coating process to make the paperboard resistant to water penetration and resulting degradation. It is desirable to be able to recycle this particular type of paper stock into new food grade paperboard suitable for manufacturing paper cups or other direct contact food containers while maintaining a sanitary environment and ensuring a high degree of segregation to avoid the inclusion of any hazardous or deleterious materials.

Due to the increasing public, private and government interest in "going green" and being environmentally friendly, there exists renewed interest and demand on recycled products having greater percentages of recycled material content. Thus, this demand will require new and effective systems and methods of recycling waste into renewable products.

SUMMARY OF THE INVENTION

A first object of the present invention is to provide a waste recycling system using tagged, bar coded and/or otherwise distinctively marked plastic bags or other containers, for example, composite bags, composite paper bags, composite plastic/paper bags, non-composite paper bags, plastic containers, plastic boxes, paper boxes, and cardboard boxes, for collecting targeted waste.

A second object of the present invention is to provide a waste recycling system using electronically tagged, bar coded, and/or otherwise distinctively marked plastic bags or other containers.

A third object of the present invention is to provide a waste recycling system using tagged, bar coded, and/or otherwise distinctively marked plastic bags or other containers for collecting and tracking custody of targeted waste from collection to recycling.

A fourth object of the present invention is to provide a waste recycling system for identifying electronically tagged, bar coded, and/or otherwise distinctively marked plastic bags or other containers containing targeted waste from a general waste stream or recyclable waste stream.

A fifth object of the present invention is to provide a waste recycling system for electronically sorting electronically tagged, bar coded, and/or otherwise distinctively marked plastic bags or other containers containing a targeted waste from a general waste stream or recyclable waste stream.

A sixth object of the present invention is to provide a waste recycling collection system, which affords the ability to track custody of targeted waste from the waste receptacle to the recycling process to eliminate contamination of the targeted waste being recycled.

A seventh object of the present invention is to provide a waste recycling method of using electronically tagged plastic bags or other containers, for example, including at least one RFID, UHFID or similar wireless electronic tag associated therewith for collecting targeted waste and tagging the plastic bags or other containers to allow locating and sorting of the plastic bags, for example, from the general waste stream at a waste collection center or from recyclables at a waste recycling center An eighth object of the present invention is to provide an electronically tagged plastic bag device or other container.

A ninth object of the present invention is to provide an electronically tagged plastic bag device or other container including at least one RID, UHFID or similar wireless electronic tag.

A tenth object of the present invention is to provide a plastic bag or other container device including an electronic tag, for example, at least one RFID, UHFID or similar wireless electronic tag for electronically tagging the plastic bag or other container device and targeted waste contents thereof.

An eleventh object of the present invention is to provide a system of recycling using a tagged, electronically tagged, bar coded, and/or otherwise distinctively marked plastic bags or other containers, which can be tracked and monitored for each individual targeted waste generating location with regards to their specific volumes and the quality of their specific material.

The present invention is directed to a system, and method, for recycling waste, in particular targeted waste. Further, the present invention is directed to a plastic bag or other container device (i.e. containment device) for use in the system and method according to the present invention. The other containers, for example, are composite bags, composite paper bags, composite plastic bags, composite plastic/paper bags, non-composite paper bags, plastic boxes, paper boxes, and cardboard boxes and other suitable containers that can be used to collect targeted waste and be tagged and/or marked to allow later sorting from other waste or recyclables.

The present invention is particularly suitable for recycling targeted waste. Targeted waste is a particular type of waste selected to be collected and recycled such as a particular item and/or similar type of material. For example, used paper cups are targeted waste to be recycled into foodboard, which can be made into new paper cups having a certain percentage of recycled material content. The targeted waste is collected and/or sorted to be the same item or material content mainly for facilitating the recycling process to make recycled stock materials. As another example, containers made of the same plastic material (e.g. polyethylene, PET, polyurethane) are targeted waste to be collected and sorted, and then recycled. The targeted plastic waste is sorted and collected into the same plastic bags.

In a preferred embodiment, targeted waste is collected in a recycling receptacle such as a garbage can, trash can, receptacle, garbage receptacle, trash receptacle, box or container. Specifically, marked waste receptacles (i.e. marked for the particular item or material) for collecting only the targeted waste(s) are set up in the store so that customers and/or employees of the store selectively dispose of the targeted waste(s) into the marked waste receptacles. For example, a recycling receptacle having a sign for "USED PAPER CUPS ONLY" is printed or displayed on the receptacle to indicate to customers and/or employees to only place used paper cups only into this particular marked receptacle. In a preferred embodiment, the marked waste receptacle is fitted with a removable plastic bag or liner to contain and remove the targeted waste from the marked waste receptacle when filled or being emptied, for example, at closing of the store for the day.

In the paper cup example, it is desirable to shred the used paper cups at the location of the store, thus affording an additional sorting step and allowing a higher bulk density for containment and shipping. For example, a paper shredder is located at the store for this purpose. The paper shredder can be located in the customer area (i.e. front of the store) so that customers of the store throw the used paper cups directly into the paper shredder fitted with a removable plastic bag or liner. Alternatively, the paper shredder is located in a non-customer accessed portion of the store (i.e. back of the store), and employees periodically empty used paper cups from waste receptacle(s) into the paper shredder, which shreds the used paper cups and places them is a plastic bags or liners readied for transportation from the store.

The plastic bags or other containers utilized in the system and method according to the present invention are provided with at least one tag, preferably and electronic tag such as an RF tag (e.g. RFID, UHFID), or similar wireless electronic tag to electronically tag the plastic bags. Alternatively, or in addition, the bags may be marked with a bar code or other distinctive marking to identify the bag. For example, each RF device or bar code can be unique to one bag or other container. The RF tags can be associated with the plastic bags or other container in a variety of different ways. For example, the at least one RF tag is loosely placed inside each plastic bag or other container (e.g. by the manufacturer or person at the store location), or secured or attached to the plastic bag or other container by heat bonding, adhesive, pocketing, plastic tie and/or mechanically to the outside or inside of the plastic bag or other container. Preferably, the at least one RF tag is located inside the tagged plastic bags or other container in an effort to maintain the RF tag or tags within the particular plastic bag or other container throughout use of the plastic bags or other container to avoid loss or separation from the plastic bag or other container.

In a preferred embodiment, multiple RF tags are associated with each plastic bag or other container to provide redundancy in the event one or more RF tags are damaged or disabled so that the plastic bag or container can still be located, for example, in the general waste stream at a waste collection center. The RF tags are relatively inexpensive, and thus economical allowing for redundancy of the RF tags in the applications of the present invention(s).

The plastic bags or other containers containing the targeted waste can be selectively picked up and collected from multiple stores, however, the costs may prohibitive such selective transport of this waste. A less costly alternative involves collecting the targeted waste as part of the general waste stream collection process or as part of another recycling collection. For example, it is desirable that the tagged plastic bags or other containers containing the targeted waste are co-mingled along with the other store waste, and then transported together as a general waste stream to a waste collection center. Alternatively, the plastic bags or other container containing the targeted waste can be co-mingled with recyclables (i.e. other bulk materials collected for recycling), and sent to a recycling center.

Electronic detectors for the RF tags are provided at the processing centers to locate the electronically tagged plastic bags or other containers containing the targeted waste. For example, the electronic detectors could be located on garbage trucks, unloading docks, sorting fields or areas, conveyors, chutes, or other suitable location or locations at a waste processing center.

The tagged plastic bags or other containers according to the present invention are sorted by manual or automated procedure, and collected together at the processing center. These plastic bags or other containers are aggregated (e.g. baled or palletized) and then transported to a plant for recycling. For example, the shredded cups are transported to a paper mill where they are broken down into their constituent parts, and the fiber is reprocessed into pulp suitable for manufacturing into products with direct food contact. At this point the resultant pulp can either be sold or made into paper or paperboard. If the pulp is made into foodboard, one possible application is making paper cups.

DETAILED DESCRIPTION OF PREFERRED EMBODIMENTS

Figure 1:
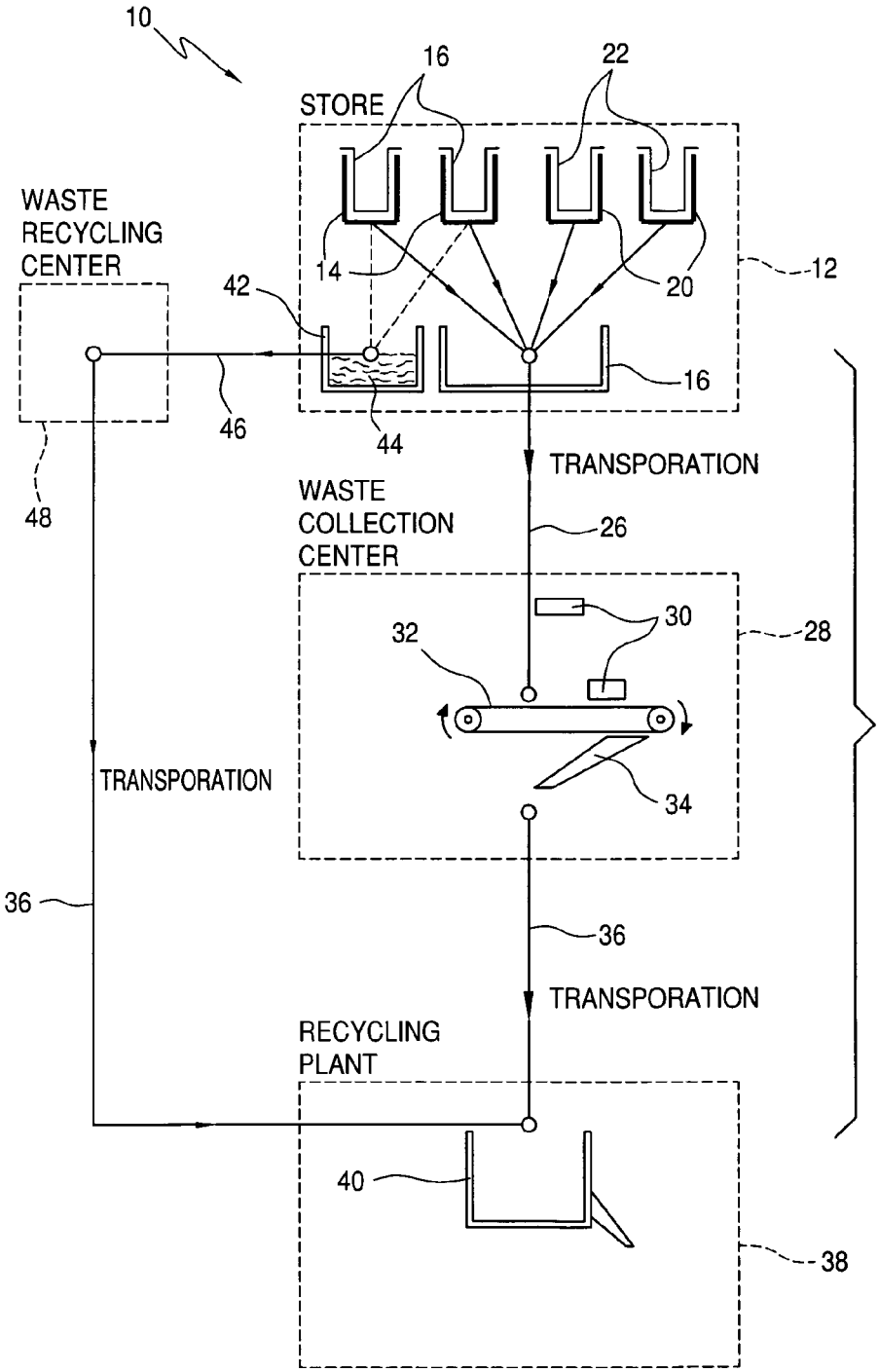
FIG. 1 is a schematic diagram showing the recycling of targeted waste from a store into new products having recycled content.

A schematic diagram of the waste recycling system 10 according to the present invention is shown in FIG. 1.

The waste recycling system begins at a store location 12. Preferably the store location 12 is just one of a series of stores of similar or dissimilar ownership that have agreed to cooperate with the desired recycling program to obtain the quantity of used waste material required for commercial recycling.

It is important to note that the preferred embodiments described in this section are directed towards particular types or otherwise targeted waste, for example, used paper cups and used plastic beverage containers. However, the system, method and device according to the present invention can have many applications for recycling different types of waste and maintaining separation and custody of the waste from the point of collection to the recycling process or processing plant to avoid contamination of the particular waste material.

The initial selective collection of the targeted waste is a preferred initial step to avoid any mixing of the targeted waste with other general waste to avoid any contamination of the targeted waste. Further, providing and maintaining a hygienic environment from start to finish by using new plastic bags or other containers, which are substantially sanitary due to the method of manufacturing, maintains the quality of the targeted waste material through the collection, transportation, sorting and recycling steps. Typically, the food or beverage contamination of the used containers, for example paper cups, is not a factor effecting the final quality and sanitary standards of the recycled pulp or other finished product, since this type of contamination is effectively removed in the recycling process, for example, when making paper stock with recycled content from the waste paper material from the used paper cups.

In the preferred embodiment, the used paper cups are collected in marked recycling receptacles 14 (e.g. garbage can, trash can, garbage receptacle, trash receptacle, carboard box, cardboard container, paper container, paper box, composite container, composite box, specialized container). The receptacles 14 are marked so as to identify the particular type or targeted waste to be discarded into the marked waste receptacle 14. For example, the marked recycling receptacle 14 can be marked "USED PAPER CUPS ONLY" by a sign, label, printing, or other suitable display manner.

As an option or improvement, the marked waste receptacles 14 in the store are paper shredders and/or compactors configured to shred and/or compact the used paper cups. The paper shredder and/or compactor can be located in the front portion of the store allowing customer access, or can be located in a back portion of the store to only allow employee access and operation of the shredder and/or compactor. The paper shredder and/or compactor use plastic bags or liners (e.g. heavier gauge plastic bags) including at least one RF tag associated therewith for electronically tagging the plastic bag or liner.

The marked recycling receptacles 14 are located inside the store 12 where customers have access to these marked recycling receptacles 14 so that customers discard their used paper cups or plastic beverage containers into the marked recycling receptacles 14 when finished consuming their beverages. The marked recycling receptacles 14 may each be fitted with a plastic bag 16 having at least one RF tag 18 associated therewith.

Alternatively, employees of the store 12 can sort through regular waste receptacles 20 (i.e. unmarked waste receptacles) in the store 12 having standard plastic bags 22 (i.e. having no RF tags), to selectively remove and sort the used paper cups or plastic beverage containers from the other general store waste. The sorted used paper cups or beverage containers are then collected in plastic bags 16 each having at least one RF tag 18 associated therewith. However, this method of sorting the used paper cups or plastic beverage containers from the other general store waste is more labor intensive and expensive. Further, the targeted waste can be contaminated from the other general store waste materials, and is less desirable from initially separating the targeted waste into the marked waste receptacles 14.

The electronically tagged plastic bags 16 are removed from the marked recycling receptacles 14, and then collected with the regular plastic bags 22 containing general store waste from the store 12. Both the tagged plastic bags 16 and regular plastic bags 20 are thrown into a dumpster 24 together to then enter the general waste stream 26. Alternatively, a garbage truck picks up the plastic bags 16, 20 together directly from the store 12. The electronically tagged plastic bags 16 containing the targeted store waste and the regular plastic bags 20 containing the general store waste are co-mingled together in the dumpster 24 or garbage truck, and are transported together as a general waste stream 26 to a waste collection center 28. Alternatively the electronically tagged plastic bags 16 or other containers are kept segregated from the regular plastic bags 20 containing the general store waste and are co-mingled with other materials (e.g. cardboard) that is currently being recycled by the individual store.

In another embodiment, the receptacle 14 itself is made to be recycled along with the targeted waste contents contained therein to directly serve as a waste "container" according to the present invention. For example, the receptacle 14 can be a paper or cardboard box that is electronically tagged with at least one RF tag associated therewith. Alternatively, the filled receptacle 14 is placed in a plastic bag 16 electronically tagged with at least one RF tag associated therewith. The receptacle 14 and targeted waste contents contained therein are discarded into the dumpster 24 or garbage truck as a unit. This particular receptacle 14 may or may not have a plastic bag or linear depending on the particular application. In any event, it is desirable that such a receptacle remains intact when co-mingled with the waste stream and then later be sorted out, for example, at a waste collection center.

The waste collection center 28 includes one or more RF sensors 30 for electronically detecting the electronically tagged plastic bags 16 or containers containing the targeted store waste. An RF sensor 30 can be located near or adjacent a location where the dumpsters 24 or garbage trucks unload the general waste stream 26, for example, onto a sorting floor of the waste collection center 28. Unloading and/or sorting equipment such as lifts or trucks can be fitted with RF sensors 30 to locate the electronically tagged plastic bags 16, containing the targeted store waste, being moved or sorted on the sorting floor. Alternatively, the general waste stream 26 is loaded onto a sorting conveyor 32 fitted with one or more RF sensors 30 located along the sorting conveyor 32. The sorting conveyor 32 can be fitted with a mechanism to "kick out" the electronically tagged plastic bags 16 from the sorting conveyor 32 onto a chute 34 (or another conveyor) to sort out and collect the electronically tagged plastic bags 16.

The electronically tagged plastic bags 16 containing the targeted store waste are collected (e.g. placed on pallets) for transportation as a targeted waste stream 36 to a recycling plant 38 such as a paper mill or plastic pellet manufacturing plant. For recycling paper cups, the targeted store waste is shipped to a paper mill for recycling into new paper stock having recycled material content. Once at the paper mill each individual bag is automatically weighed and a generator's attribution established. The targeted waste quantity and quality along with collection and transportation data is recorded and used for quality control purposes.

Alternatively, or in addition, the store 12 can be provided with a separate dumpster 42 for collecting a recyclable waste 44, for example, cardboard waste. The electronically tagged plastic bags 16 can also be collected in the dumpster 42, and co-mingled with the recyclable waste 44. The recyclable waste stream 46 is transported to a waste recycling center 48, at which the electronically tagged plastic bags 16 are sorted from the recyclable waste 44.

The electronically tagged plastic bags 16 can be provided with a single RF tag 18, or preferably multiple RF tags 18 to provided operational redundancy in the event one or more of the RF tags are separated from the plastic bags 16, or damaged. The RF tags 18 are preferably adhesively secured to the inside of the plastic bags 16 during manufacturing of the plastic bags 16. A targeted waste stream 36 is transported from the waste recycling center 48 to the recycling plant 38 for recycling into new products having recycled content.

Figure 2:
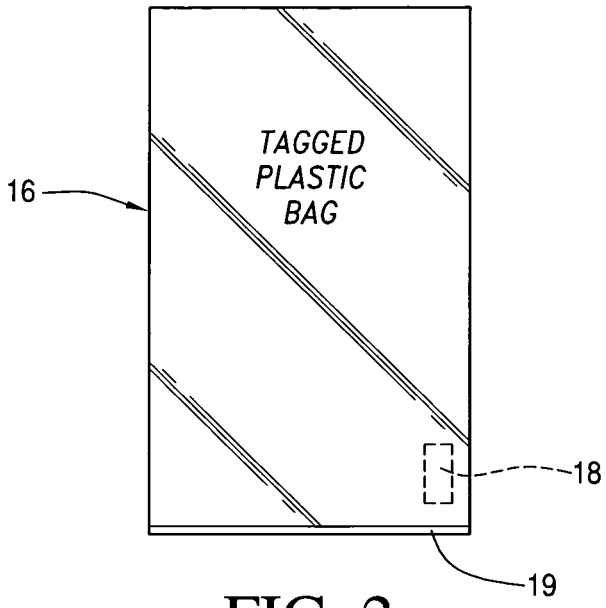
FIG. 2 is side elevational view of a new unopened electronically tagged plastic bag or other container device according to the present invention having at least one RF tag.
Figure 3:
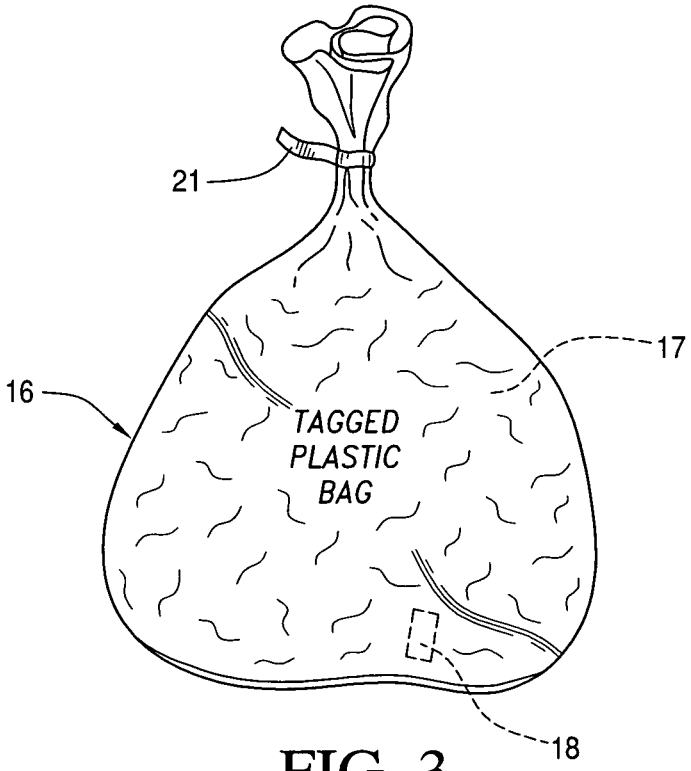
FIG. 3 is a side elevational view of a used filled plastic bag or other containment device according to the present invention having at least one RF tag containing targeted waste readied for transportation to a processing plant.

The electronically tagged plastic bags 16 according to the present invention are shown in FIGS. 2 and 3.

As shown in FIG. 2, a newly manufactured unopened and unused flat plastic bag 16 is shown. The RF tag 18 is located inside the plastic bag 16 preferably near or at the bottom thereof. A heat welded seam 19 defines the bottom of the plastic bag 16. As shown in FIG. 3, the plastic bag 16 is filled with targeted waste 17 (e.g. shredded paper cups or plastic bottles), however, the RF tag 18 remains adhered and attached to the inside surface of the plastic bag 16 to prevent separation from the plastic bag 16. A plastic tie 21 can be used to close an upper portion of the plastic bag 16, or the upper end of the plastic bag 16 can be tied into a knot to close same.

The waste recycling method according to the present invention includes the step of collecting targeted waste in electronically tagged plastic bags. This method maintains the targeted waste separate from other waste to maintain the custody of the targeted waste.

Preferably, the target waste is collected immediately after use, for example, after a store customer consumes his or her beverage and then discards the used container. Collecting the targeted waste in marked waste receptacles allows for the targeted waste to be immediately sorted from other waste, and greatly reduces the risk of contamination by other store waste. Optionally, it is desirable to shred the beverage containers (e.g. used paper cups) at the store location to facilitate the recycling thereof.

We claim:

1. An onsite store waste recycling method, comprising:

collecting targeted store waste onsite at a store location and tracking the collected store waste from the store location to a recycling facility to maintain a chain of custody of the targeted store waste from the store location to the recycling facility;

manufacturing a flat plastic bag comprising an open top, closed bottom, and at least one wireless electronic tag placed inside the plastic bag;

placing a waste collection receptacle onsite in a customer area of the store;

placing the tagged plastic bag into the onsite waste collection receptacle;

placing targeted store waste onsite into the waste collection receptacle;

shredding the targeted store waste onsite after being placed into the waste collection receptacle fitted with the tagged plastic bag;

transporting the tagged plastic bag containing the targeted store waste from the store to the recycling location; and recycling the targeted store waste into at least one recycled material suitable for use in manufacturing one or more products containing recycled material content from the targeted store waste.

2. The method according to claim 1, including securing the wireless electronic tag to the plastic bag.

3. The method according to claim 1, including adhering the wireless electronic tag to the plastic bag.

4. The method according to claim 1, including closing an upper portion of the plastic bag with a tie.

5. The method according to claim 1, including tying an upper end of the plastic bag into a knot to close the upper end of the plastic bag.

6. The method according to claim 1, wherein multiple RF tags are associated with the plastic bag.

7. The method according to claim 1, including compacting the targeted store waste.

8. The method according to claim 1, including seaming the plastic bag during manufacturing to define a bottom of the plastic bag.

9. The method according to claim 1, including positioning the at least one wireless electronic tag at a bottom of the plastic bag.

10. The method according to claim 1, including attaching the at least one RF tag to an inside surface of the plastic bag.

11. The method according to claim 1, wherein the targeted waste is post consumer beverage and food containers.

12. The method according to claim 11, wherein the post consumer beverage or food containers are recycled into beverage or food containers having recycled material content.

13. The method according to claim 1, including co-mingling the collected plastic bags with other waste or recyclables from the store waste and transported together to a waste processing center as a general waste stream or alternatively collected and transported with other recycable material.

14. An onsite store material recycling method, the method comprising the steps of:

manufacturing a flat plastic bag comprising an open top, a closed bottom, and at least one wireless electronic tag placed within the plastic bag;

placing onsite a material collection receptacle in a store;

placing onsite the tagged plastic bag into the material collection receptacle;

placing onsite targeted store material into the tagged plastic bag placed in the material collection receptacle;

transporting the tagged plastic bag containing the targeted store material from the store to a recycling location; and recycling the targeted store material into one or more products containing recycled material content.

* * * * *